United States Patent [19]

Beaulieu

[11] Patent Number: 4,627,210

[45] Date of Patent: Dec. 9, 1986

[54] HUB ASSEMBLY FOR COLLAPSIBLE STRUCTURE

[76] Inventor: Bryan J. Beaulieu, 1205 - 132nd St. West, Burnsville, Minn. 55337

[21] Appl. No.: 792,130

[22] Filed: Oct. 28, 1985

[51] Int. Cl.[4] ..... A45F 1/16

[52] U.S. Cl. ..... 52/646; 135/28; 135/106; 403/193

[58] Field of Search ..... 135/28, 20, 26, 106–109; 52/646; 403/193

[56] References Cited

U.S. PATENT DOCUMENTS

| | | | |
|---|---|---|---|
| 3,424,180 | 1/1969 | Andolfi | 135/28 X |
| 3,613,702 | 10/1971 | Weber | 135/20 R |
| 3,766,932 | 10/1973 | Sidis et al. | 52/646 X |
| 4,280,521 | 7/1981 | Zeigler | 135/106 X |
| 4,368,749 | 1/1983 | Lindler et al. | 135/28 X |

FOREIGN PATENT DOCUMENTS

| | | | |
|---|---|---|---|
| 1298243 | 6/1969 | Fed. Rep. of Germany | 135/20 R |
| 90850 | 2/1979 | Fed. Rep. of Germany | 135/20 R |
| 550905 | 12/1922 | France | 135/28 |
| 26438 | 7/1902 | Switzerland | 135/28 |
| 373530 | 6/1964 | Switzerland | 135/28 |
| 884677 | 11/1981 | U.S.S.R. | 135/20 R |

*Primary Examiner*—J. Karl Bell

*Attorney, Agent, or Firm*—Paul L. Sjoquist

[57] ABSTRACT

A hub assembly for pivotally holding the ends of the column-like support rods which make up the skeletal frame of a collapsible, self-supporting structure, comprising extension caps for the ends of the support rods, a circular hub body with retaining slots or sockets which receive and pivotally hold the ends of the extension caps and a circular locking disk which releasably interlocks with the hub body to retain the ends of the extension caps in pivotal relationship within the hub body.

10 Claims, 6 Drawing Figures

HUB ASSEMBLY FOR COLLAPSIBLE STRUCTURE

BACKGROUND OF THE INVENTION

This invention relates to collapsible self-supporting structures, and more particularly to a hub assembly for pivotally holding the ends of the column-like support rods which make up the skeletal frames for such collapsible structures.

The collapsible structures have network support rods which are pivotally joined together for movement between a collapsed, compact position for storage or transportation and an opened condition in which the desired structural shape is attained. Dome or arch shape structures of this type may be illustrated by U.S. Pat. Nos. 3,838,703, 3,968,808, 4,026,313, and 4,290,244. Collapsible display frame structures of the type having planar or arcuate face surfaces may be illustrated by U.S. Pat. Nos. 4,276,726 and 4,471,548. Such display frames are commercially available and are useful in setting up for trade show displays and the like.

The above-mentioned patents show various hub assembly structures for pivotally holding the ends of the support rods. Also, U.S. Pat. No. 4,280,521 specifically shows a multiple-bodied hub to be fused together to capture a ring and interconnected blades which extend from the support rod ends. These hub assemblies are characterized by having multiple parts that are typically designed to be permanently assembled together.

Because of the complex nature of the network of support rods, the hub assemblies must accommodate complex movements between the collapsible structure's opened and collapsed positions. Some twisting, flexing, and straining between the hub assemblies and support rods are inherent in such structures. Additionally, with repeated opening and collapsing of the structures typically used for trade show displays, the hub assemblies are subject to wear and may break rendering the entire collapsible structure useless. Replacement or repair of a hub assembly or a support rod may be impossible or difficult in addition to being time consuming. Therefore, such replacement or repair has generally been considered not feasible for many of the aforementioned structures.

SUMMARY OF THE INVENTION

A hub assembly for pivotally holding the ends of the column-like support rods which make up the skeletal frame of a collapsible, self-supporting structure, comprising extension caps for the ends of the support rods, a circular hub body with retaining slots or sockets which receive and pivotally hold the ends of the extension caps and a circular locking disk which releasably interlocks with the hub body to retain the ends of the extension caps in pivotal relationship within the hub body.

This invention advantageously provides a hub assembly of interconnecting parts for collapsible, self-supporting structures which permit quick and easy disassembly for replacement of worn or broken parts of the hub assembly or collapsible structure, thereby extending the life span of collapsible structures incorporating this hub assembly.

The hub assembly further provides a ball and socket-like arrangement which is believed to make opening and collapsing of such structures easier while adding durability to the hub assembly.

DESCRIPTION OF THE PREFERRED EMBODIMENT

Figure 1:
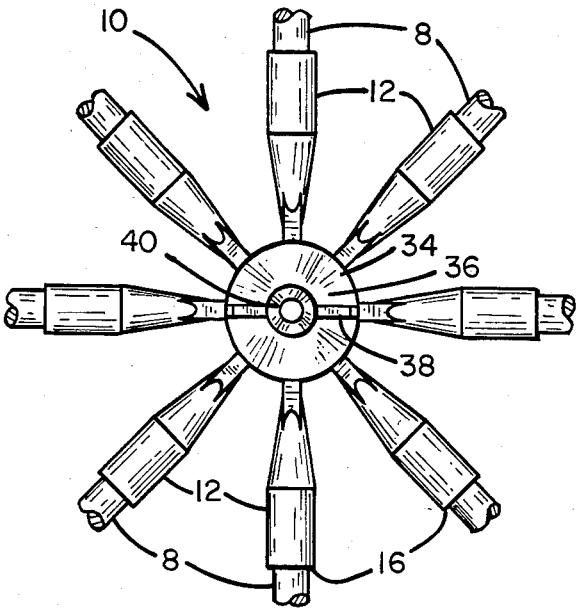
FIG. 1 is a top view of a hub assembly according to the invention.
Figure 2:
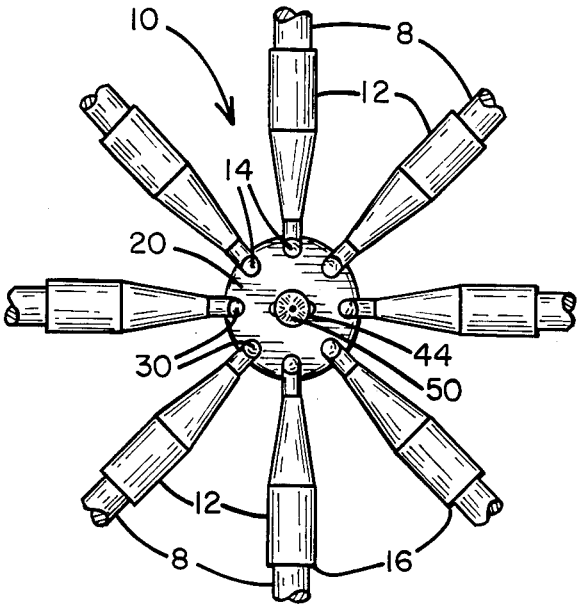
FIG. 2 is a bottom view of the hub assembly.

Referring to FIGS. 1 through 4, hub assembly 10 generally includes spoke-like extension caps 12 to be affixed to the ends of the support rods 8 of one of the before mentioned collapsible structures. The spherical heads 14 of caps 12 fit within retaining slots or sockets 30 of the circular hub body 20 comparable to a ball-and-socket arrangement. Circular locking disk 34 releasably interlocks with hub body 20 to thereby pivotally hold extension caps 12 within hub body 20. The parts of hub assembly 10 is preferably made of durable, resilient plastic, such as nylon, Delrin or the like, which has inherent lubricity.

More specifically, extension caps 12 each preferably have a tapering portion which suitably ends in a spherical enlarged head 14. The opposite hollow end or shank 16 of cap 12 preferably has an opening 18 for sliding over the end of a support rod 8 and to be appropriately fastened thereat, such as by glue or by other appropriate bonding techniques.

Figure 5:
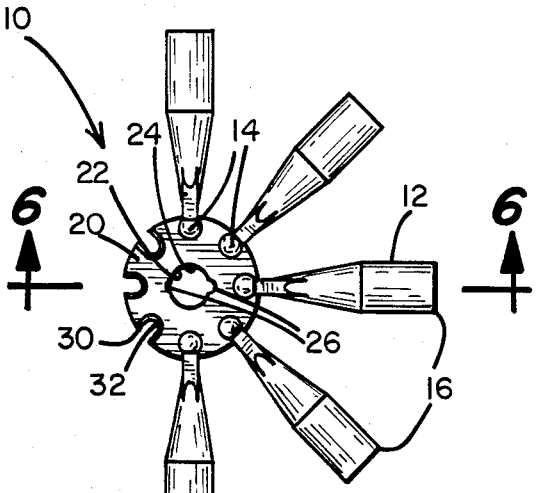
FIG. 5 is a top view of the hub body of the hub assembly.
Figure 6:
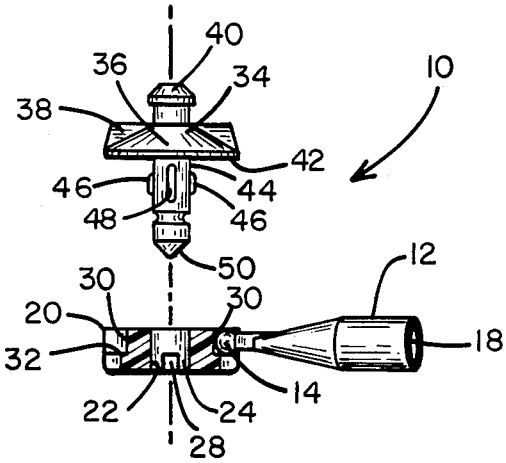
FIG. 6 is a side elevational view of the locking disk and hub body, the hub body being in cross sectional view along lines 6—6 of FIG. 5.

As additionally shown in FIGS. 5 and 6, circular hub body 20 has a central opening 22 which forms inner wall 24. Opposing elongated grooves 26 in inner wall 24 preferably extend the length of opening 22. Opposing locking notches 28, specifically shown in FIG. 6 are located near the base of inner wall 24.

Preferably eight retaining slots or sockets 30, each preferably being circular in cross section, extend radially inward through the thickness of hub body 20. Shoulders or collars 32 are located approximately near the middle of each retaining slot 30's length. The spherical heads 14 of extension caps 12 fit within retaining slots or sockets 30 while shoulders 32 provide seats to prevent heads 14 from passing therethrough, analogous to a ball-and-socket relationship. By this arrangement, extension caps 12 may pivot at their heads 14 and additionally accommodate twisting and flexing movement of hub assembly 10 and support rods 8 of the specified collapsible structure.

Circular locking disk 34 pivotally holds and prevents heads 14 of extension caps 12 from being lifted out of retaining slots or sockets 30. Disk 34 has a top face 36 with a manually grippable handle 38 thereon. Fastening button 40 is also centrally located on top face 36 and may be utilized for attaching other structural components to the collapsible structure, such as shelving, lights or panels which are useful for trade show displays and further disclosed in my copending applications. Bottom face 42 of disk 34 has a centrally located boss or bayonet 44 suitably of a length to extend beyond the thickness of hub body 20. Bayonet 44 suitably has opposing protrusions or knobs 46 on its side for cooperative or matched sliding engagement with elongated grooves 26 of hub body 20 to thereby properly align bayonet 44 with central opening 22. Slit 48 on bayonet 44 adds resiliency to bayonet 44 between knobs 46 to permit relative movement or flexing of knobs 46 with respect to each other to readily effect a snap-locking arrangement with locking notches 28. The end of bayonet 44 has a male snap fastener 50 construction suitable for attachment of other structural components, such as for interconnection of inner and outer apical hub assemblies which are typical of the collapsible self-supporting structures utilizing this hub assembly.

In operation, extension caps 12 are affixed to the ends of support rods 8 which make up the skeletal frame of the collapsible structure. The spherical heads 14 on the tapered end of extension caps 12 are then positioned within retaining slots or sockets 30 with shoulders 32 providing seats to prevent their passing therethrough. Circular locking disk 34 is then manually grasped by handle 38 and bayonet 44 is guided into central opening 22 of hub body 20. The cooperation of knobs 46 and elongated grooves 26 assure proper alignment of bayonet 44 within central opening 22 and a confronting relationship between the disk 34's bottom face 42 and the top of hub body 20. Upon full insertion of bayonet 44 into opening 22, disk 34 is then twisted 90° in either direction by handle 38 thereby locking knobs 46 within locking notches 28 and pivotally securing extension cap 12 within hub assembly 10 in a spoke-like fashion. This process is repeated for as many hub assemblies 10 as are needed for the particular collapsible structure.

Figure 3:
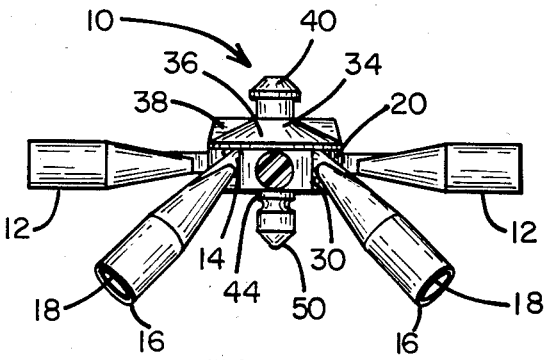
FIG. 3 is a side elevational view of the hub assembly in extended or open position.
Figure 4:
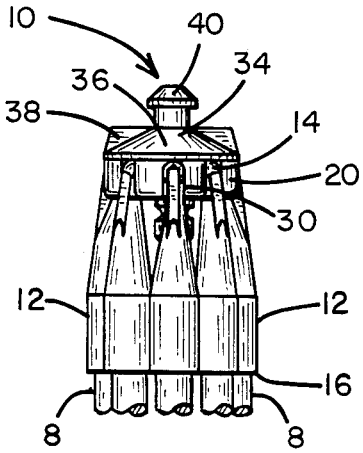
FIG. 4 is a side elevational view of the hub assembly with the collapsible structure in a folded position.

As specifically shown in FIGS. 3 and 4, this construction permits approximately 90° pivotal movement of extension caps 12 thereby permitting the collapsible structure to assume either its fully open or collapsed positions. Fastening button 40 and male snap fastener 50 permit attachment of other structural components to the hub assembly thereby adding more functionality to the collapsible structure.

Should one of the support rods 8 or extension caps 12 become damaged or broken, the hub assembly 10 is simply disassembled by rotating the locking disk 34 90° in either direction which will release the interlocking connection between knobs 46 and locking notches 28. Locking disk 34 may then be pulled away. With locking disk 34 removed from hub body 20, any of the individual extension caps 12 or parts of hub assembly 10 may be removed and replaced thereby extending the life span of the collapsible structure.

The present invention may be embodied in other specific forms without departing from the spirit or essential attributes thereof, and it is therefore desired that the present embodiment be considered in all respects as illustrative and not restrictive, reference being made to appended claims rather than to the foregoing description to indicate the scope of the invention.

That which is claimed is:

1. A hub assembly for pivotally holding the ends of column-like support rods which make up the skeletal frames of collapsible, self-supporting structures, comprising (a) a plurality of support rod ends, each support rod end comprising a spherical head joined to a neck having a narrowed portion adjacent the head and an enlarged portion adjacent a rod, said enlarged portion including a receptacle for receiving a rod;

(b) a circular hub body having a circumference arranged with a plurality of radially inward extending retaining sockets, each socket adapted for receiving and pivotally holding a head of one of said support rod ends, said hub body further having a central opening extending axially relative to said circumference;

(c) a circular locking disk having top and bottom faces, the bottom face having a centrally located bayonet adapted for reception into the central opening to align the bottom face of the disk in confronting relationship with the hub body to thereby retain the heads of the support rod ends within the sockets; and (d) releasable interlocking means for holding the bayonet within the central opening to thereby pivotally secure the support rod ends to form the hub assembly.

2. The assembly of claim 1, wherein the releasable interlocking means comprises the combination of a protrusion on the side of the bayonet and an elongated groove and locking notch in an inner wall of the central opening, the groove adapted for slidably receiving the protrusion and the notch adapted for holding the protrusion therein to thereby retain the bayonet within the central opening.

3. The assembly of claim 1, wherein said support rod ends further comprise extension caps having a spherical head end and a rod-receiving tubular end.

4. The assembly of claim 1, wherein the hub body has retaining sockets ranging between three and eight in number.

5. The assembly of claim 1, wherein the retaining sockets each have a shoulder to provide a seat to hold and prevent the head of a support rod end from passing therethrough.

6. The assembly of claim 1, wherein the central opening and the bayonet are round in cross section.

7. The assembly of claim 1, further comprising a handle on the top face of the locking disk adapted to aid in manual interlocking and unlocking the locking disk with the hub body.

8. The assembly of claim 1, further comprising a fastening button located on the top face of the locking disk.

9. The assembly of claim 1, wherein the bayonet extends through and beyond the central opening when the disk and hub body are in confronting relationship.

10. A resilient, plastic hub assembly for pivotally holding the ends of support rods which make up the skeletal frames of collapsible, self-supporting structures, comprising (a) a plurality of extension caps, each having an end with an essentially spherical enlarged head and a hollow end opposite its head adapted for attachment to the end of a support rod by sliding thereover;

(b) a circular hub body having a central opening extending through the body forming an inner wall and three to eight radially inward extending retaining sockets, each socket being circular in cross section having a shoulder forming a seat located near the middle of its length thereby being adapted for receiving and pivotally holding one of the heads of the caps;

(c) a circular locking disk having top and bottom faces, the bottom face having a centrally located bayonet adapted for reception into the central opening to align the bottom face of the disk in confronting relationship with the hub body thereby retaining the heads of the caps within the hub body, the bayonet extending through and beyond the central opening when the disk and hub body are in confronting relationship, and the top face having a fastening button thereon and a handle for manually gripping the locking disk; and (d) releasable interlocking means comprising the combination of a protrusion on the side of the bayonet and an elongated groove and locking notch in the inner wall of the central opening, the groove adapted for slidably receiving the protrusion and the notch adapted for holding the protrusion when aligned therewith to thereby hold the bayonet within the central opening and lock the disk to the hub body.

* * * * *